United States Patent [19]

Nitta

[11] Patent Number: 4,471,404

[45] Date of Patent: Sep. 11, 1984

[54] MOVABLE ELECTRODE TYPE ELECTRONIC GAS LIGHTER

[75] Inventor: Tomio Nitta, Yokohama, Japan

[73] Assignee: Tokai Seiki Co., Ltd., Yokohama, Japan

[21] Appl. No.: 520,856

[22] Filed: Aug. 5, 1983

[30] Foreign Application Priority Data

Aug. 12, 1982 [JP] Japan ..... 57-122585

[51] Int. Cl.[3] ..... F23Q 2/08; F23Q 3/01; F23Q 13/00

[52] U.S. Cl. ..... 361/247; 431/131; 431/255

[58] Field of Search ..... 361/247, 253; 431/129, 431/130, 131, 254, 255

[56] References Cited

U.S. PATENT DOCUMENTS

| | | | |
|---|---|---|---|
| 3,280,600 | 10/1966 | Meyers | 431/131 X |
| 3,408,153 | 10/1968 | Ishiguro | 431/255 X |
| 3,576,383 | 4/1971 | Fuller et al. | 431/255 |
| 3,883,289 | 5/1975 | Fujioka | 431/131 |

*Primary Examiner*—Donald A. Griffin

*Attorney, Agent, or Firm*—Curtis, Morris & Safford

[57] ABSTRACT

An electronic gas lighter is provided with an electricity generating device having a movable electrode. A movable part carrying the movable electrode is moved downward to ignite fuel discharged from a nozzle disposed on a fuel tank. A partition is provided between the movable part and the nozzle.

3 Claims, 4 Drawing Figures

MOVABLE ELECTRODE TYPE ELECTRONIC GAS LIGHTER

BACKGROUND OF THE INVENTION

1. Field of the Invention

This invention relates to an electronic cigaret gas lighter, and more particularly to an electronic cigaret gas lighter having a movable electrode. (The gas lighter of this type will be referred to as "a movable electrode type electronic gas lighter" hereinbelow.)

2. Description of the Prior Art

An ignition device having an electricity generating device such as a piezoelectric device is widely used in a high class lighter having a metal body, but is not used so widely in a disposable lighter having a plastic body. This is mainly due to the manufacturing cost, and therefore if the manufacturing cost is sufficiently lowered, a plastic lighter having a piezoelectric ignition device can be realized.

From the viewpoint of the manufacturing cost, it is preferred that the components can be manufactured at a low cost, and be of such a structure as to easily permit automated assembly thereof.

This applicant has proposed an inexpensive electronic gas lighter comprising a casing in which a fuel tank and an electricity generating device receiving portion are integrally formed, and an electrode movable type electricity generating device received in the receiving portion, the outlet of fuel from the fuel tank (nozzle) being positioned on the fuel tank. The electricity generating means has a structure which permits easy assembly thereof. The electronic gas lighter is shown in FIG. 1.

In FIG. 1, reference numerals 1, 2, 3, 4 and 5 respectively indicate a casing, a fuel tank, an electricity generating device receiving portion, a nozzle and an electricity generating device. An actuating cap 6 is mounted on the top of the electricity generating device 5. Depression of the actuating cap 6 impacts on a piezoelectric element (not shown) in the electricity generating device 5 and a high voltage is generated between an outwardly projecting lead member 9 connected to one pole of the piezoelectric element and the nozzle 4 electrically connected to the other pole of the piezoelectric element, whereby discharge occurs between the lead member 9 and the nozzle 4 to ignite fuel discharged through the nozzle 4 in response to the depression of the actuating cap 6.

However, this lighter has encountered a problem that the fuel is apt to miss being ignited when the actuating cap 6 is quickly depressed. This is because when the actuating cap 6 is depressed quickly and the movable part of the electricity generating device 5 moves downward at a relatively high speed, air around the nozzle and the flow of fuel are disturbed and the air/fuel ratio required to effectively ignite the fuel cannot be obtained. Generally, the time required to depress the electricity generating device 5 is about 150 msec at most, but it is reduced as short as 50 msec when the actuating cap 6 is quickly depressed.

SUMMARY OF THE INVENTION

In view of the foregoing observations and description, the primary object of the present invention is to provide a movable electrode type electronic gas lighter in which fuel can be surely ignited even when the electricity generating device is quickly depressed.

The movable electrode type electronic gas lighter in accordance with the present invention is characterized by a partition disposed between the nozzle and the electricity generating device.

In the electronic gas lighter in accordance with the present invention, even if air around the generating device is disturbed, the disturbance is prevented from affecting air around the nozzle by the partition. Therefore, an optimal air/fuel ratio is ensured around the nozzle even when the movable part of the generating device is depressed at a high speed.

DESCRIPTION OF THE PREFERRED EMBODIMENTS

Figure 1:
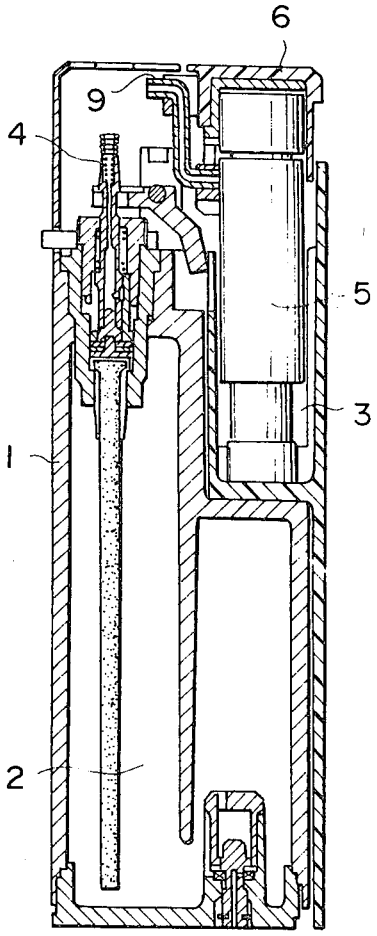
FIG. 1 is a cross sectional view of a movable electrode type electronic gas lighter in accordance with the prior art.
Figure 2:
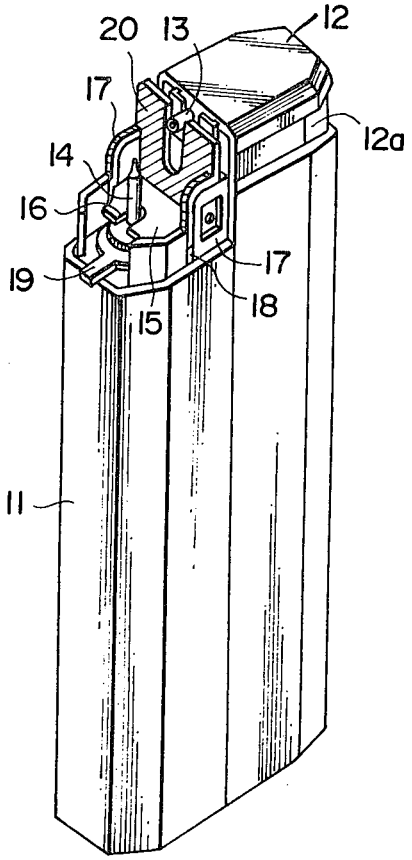
FIG. 2 is a perspective view of a movable electrode type electronic gas lighter in accordance with an embodiment of the present invention with the wind shield cap being removed.

In FIG. 2, reference numerals 11, 12 and 13 respectively indicate a plastic casing, an actuating cap and a lead member. The lead member 13 is connected with one pole of a piezoelectric element of an electricity generating device which is not shown but is similar to that of the lighter shown in FIG. 1. A nozzle 14 is received in a central cutaway portion 16 of a valve actuator lever 15 and is connected to the other pole of the piezoelectric element. The valve actuator lever 15 is pivotted on a pair of opposed side plates 17. Each side plate 17 is provided with a cutaway portion 18, the purpose of which will become apparent later. Reference numeral 19 indicates a flame height control valve.

Figure 3A:
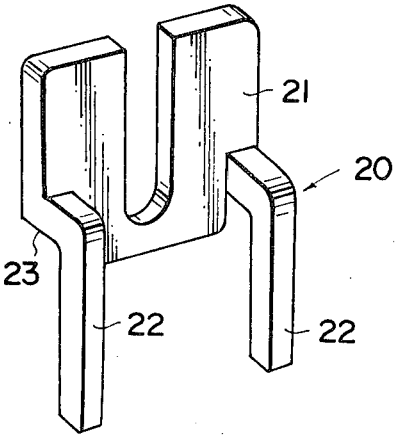
FIG. 3A is an enlarged perspective view of the partition employed in the lighter shown in FIG. 2.
Figure 3B:
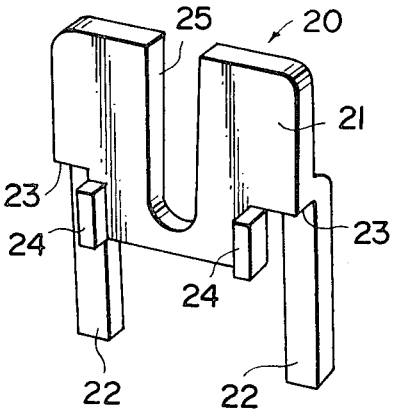
FIG. 3B is a perspective view of the partition shown in FIG. 3A as seen from behind.

A partition 20 is disposed between the nozzle 14 and the movable part 12*a* of the electricity generating device which is moved downward in response to depression of the actuator cap 12 and is moved upward upon release of the actuator cap 12. As shown in FIGS. 3A and 3B, the partition 20 comprises a separating wall portion 21, a pair of supporting legs 22, a pair of abutting shoulders 23 formed between the separating wall portion 21 and the supporting legs 22 on opposite sides of the wall portion 21, and a pair of guide projections 24 projecting from the back surface of the wall portion 21. An elongated vertical slot 25 is formed in the wall portion 21. The partition 20 is supported with each supporting leg 22 being inserted into the cutaway portion 18 of the corresponding side plate 17, the abutting shoulders 23 resting on the top of the side plates 17 and the guide projections 24 being snugly fit in between the side plates 17. Further, the elongated vertical slit 25 receives the lead member 13 to permit the lead member 13 to move up and down therein.

When the actuator cap 12 is depressed to impact on the piezoelectric element in the electricity generating device, discharge occurs between the lead member 13 and the nozzle 14 to ignite fuel discharged from the nozzle 14. The valve actuator lever 15 is swung to open the valve (not shown) in response to depression of the actuating cap 12. When the actuating cap 12 is depressed and the movable part of the electricity generating device is moved downward, air around the movable part is disturbed, the disturbance of air being increased with increase of the actuating cap depressing speed. However, the disturbance of air around the movable part is prevented from being transmitted to air around the nozzle 14 by the separating wall portion 21 of the partition 20 in the lighter of this embodiment. Therefore, an optimal air/fuel ratio is obtained even if the actuating cap 13 is depressed quickly.

I claim:

1. An electronic gas lighter comprising an electricity generating device having a movable part carrying thereon an electrode, a nozzle opposed to the electrode member, and a partition extending in the direction of the movement of the movable part of the electricity generating device between the nozzle and the movable part.

2. An electronic gas lighter as defined in claim 1 wherein said partition is provided with a slit through which an electrode provided on said movable part extends toward the nozzle and moves up and down.

3. An electronic gas lighter as defined in claim 1 or 2 wherein said partition has supporting legs to be inserted into cutaway portions provided on a fuel tank of the lighter.

* * * * *